US009903364B2

(12) United States Patent
Wallin et al.

(10) Patent No.: US 9,903,364 B2
(45) Date of Patent: Feb. 27, 2018

(54) BACKUP LUBRICANT SUPPLY SYSTEM

(71) Applicants: Hans Wallin, Cape Coral, FL (US); George Lutzow, Macungie, PA (US)

(72) Inventors: Hans Wallin, Cape Coral, FL (US); George Lutzow, Macungie, PA (US)

(73) Assignee: AKTIEBOLAGET SKF, Gothenburg (SE)

( * ) Notice: Subject to any disclaimer, the term of this patent is extended or adjusted under 35 U.S.C. 154(b) by 202 days.

(21) Appl. No.: 14/561,692

(22) Filed: Dec. 5, 2014

(65) Prior Publication Data

US 2016/0160856 A1 Jun. 9, 2016

(51) Int. Cl.

| | |
|---|---|
| ***F25B 31/00*** | (2006.01) |
| ***F04B 53/18*** | (2006.01) |
| ***F04B 53/14*** | (2006.01) |
| ***F04B 53/08*** | (2006.01) |
| ***F04B 9/12*** | (2006.01) |
| ***F04B 43/06*** | (2006.01) |

(52) U.S. Cl.

CPC ..... *F04B 53/18* (2013.01); *F04B 9/12* (2013.01); *F04B 43/06* (2013.01); *F04B 53/08* (2013.01); *F04B 53/14* (2013.01)

(58) Field of Classification Search

CPC ..... F04B 53/18; F04B 53/08; F04B 53/14; F04B 9/12; F04B 9/117; F04B 43/06

USPC ..... 184/6.16

See application file for complete search history.

(56) References Cited

U.S. PATENT DOCUMENTS

| | | | | | |
|---|---|---|---|---|---|
| 2,755,787 | A * | 7/1956 | Butler | F01M 1/26 | 123/196 S |
| 3,422,807 | A * | 1/1969 | Waldecker | F01M 5/00 | 123/196 S |
| 4,821,799 | A * | 4/1989 | Wong | F16J 15/40 | 166/385 |
| 5,488,935 | A * | 2/1996 | Berry, Jr. | F01M 5/025 | 123/196 S |
| 5,494,013 | A * | 2/1996 | Helbig | F01M 5/025 | 123/196 S |
| 5,524,728 | A * | 6/1996 | Williams | F16C 33/103 | 141/65 |
| 5,772,402 | A * | 6/1998 | Goodman | F01M 11/045 | 137/205 |
| 6,066,060 | A * | 5/2000 | Harper | F16H 57/0434 | 184/10 |
| 6,102,673 | A * | 8/2000 | Mott | E21B 21/001 | 137/596.17 |
| 6,148,789 | A * | 11/2000 | Johns | F01M 5/025 | 123/196 R |
| 6,176,092 | B1 | 1/2001 | Butterworth et al. | | |
| 6,279,340 | B1 | 8/2001 | Butterworth et al. | | |
| 6,390,240 | B1 * | 5/2002 | Schmidt | F01M 11/04 | 123/196 S |
| 6,564,560 | B2 | 5/2003 | Butterworth et al. | | |

(Continued)

*Primary Examiner* — Michael A Riegelman

(74) *Attorney, Agent, or Firm* — Mark Ussai; SKF USA Inc. Patent Dept.

(57) ABSTRACT

A lubricant supply system includes a tank defining an internal volume. A divider is positioned within the tank that separates the internal volume into a first portion and a second portion. A first pump is in fluid communication with the first portion of the internal volume and configured to introduce a liquid refrigerant into the first portion of the internal volume.

16 Claims, 4 Drawing Sheets

(56) References Cited

U.S. PATENT DOCUMENTS

| | | | | |
|---|---|---|---|---|
| 7,694,748 | B2 * | 4/2010 | Oksman | E21B 1/00 173/77 |
| 2003/0019690 | A1 * | 1/2003 | Chandler | F01M 11/045 184/1.5 |
| 2003/0062222 | A1 * | 4/2003 | Helbig | F01M 5/025 184/6.3 |
| 2007/0137934 | A1 * | 6/2007 | Nappier | B23Q 11/1092 184/6.14 |
| 2009/0071754 | A1 * | 3/2009 | McArthur | F16N 7/38 184/7.4 |
| 2009/0071755 | A1 * | 3/2009 | Hsiao | F16N 7/02 184/55.1 |
| 2012/0207627 | A1 * | 8/2012 | Demers | A61M 1/1037 417/395 |
| 2012/0317995 | A1 * | 12/2012 | Brunnhofer | F02M 21/0221 62/45.1 |
| 2016/0160857 | A1 * | 6/2016 | Wallin | F25B 31/002 184/6.16 |

* cited by examiner

BACKUP LUBRICANT SUPPLY SYSTEM

BACKGROUND

A centrifugal compressor includes one or more impellers that compress a fluid. The impellers are mounted on a rotating shaft which is supported by a plurality of bearings. The bearings require a steady supply of lubricant, which is oftentimes oil. However, in some recent applications, refrigerant has been used to lubricate the bearings rather than oil. Refrigerant lubrication can be used when, for example, the compressor is part of a refrigeration chiller. A refrigeration chiller removes heat from a liquid via a vapor-compression or absorption refrigeration cycle. The cooled liquid may then be used to cool air (e.g., air conditioning) or in an industrial process.

A pump can be used to make the refrigerant to flow to the bearings. The pump may cavitate making it more difficult to supply the refrigerant to the bearings. There can also be operating conditions under which the supply of refrigerant is in inadequate supply or the state of the refrigerant is a mix of liquid and vapor such that it is unable to properly lubricate the bearings. Therefore, what is needed is a backup lubricant supply system that is capable of providing lubricant (e.g., refrigerant) to the bearings when the primary lubricant supply system is unable to lubricate the bearings.

SUMMARY

A lubricant supply system includes a tank defining an internal volume. A divider is positioned within the tank that separates the internal volume into a first portion and a second portion. A first pump is in fluid communication with the first portion of the internal volume and configured to introduce a liquid refrigerant into the first portion of the internal volume.

In another embodiment, the lubricant supply system includes a divider positioned within the tank that separates the internal volume into a first portion and a second portion. A liquid refrigerant is stored in the first portion of the internal volume, and a gas is stored in the second portion of the internal volume. A gas pump is in fluid communication with the second portion of the internal volume and configured to vary a pressure of the gas. A pressure of the refrigerant increases when the gas pump causes the pressure of the gas to increase.

A method for supplying a lubricant to a refrigeration chiller is also disclosed. The method may include introducing a liquid refrigerant into a first portion of an internal volume of a tank. A pressure of a gas in a second portion of the internal volume of the tank is increased. The refrigerant is supplied from the first portion of the internal volume of the tank to a bearing in a compressor. The compressor is positioned in the refrigeration chiller.

BRIEF DESCRIPTION OF THE DRAWINGS

The accompanying drawings, which are incorporated in and constitutes a part of this specification, illustrates an embodiment of the present teachings and together with the description, serves to explain the principles of the present teachings. In the figures.

Figure 1:
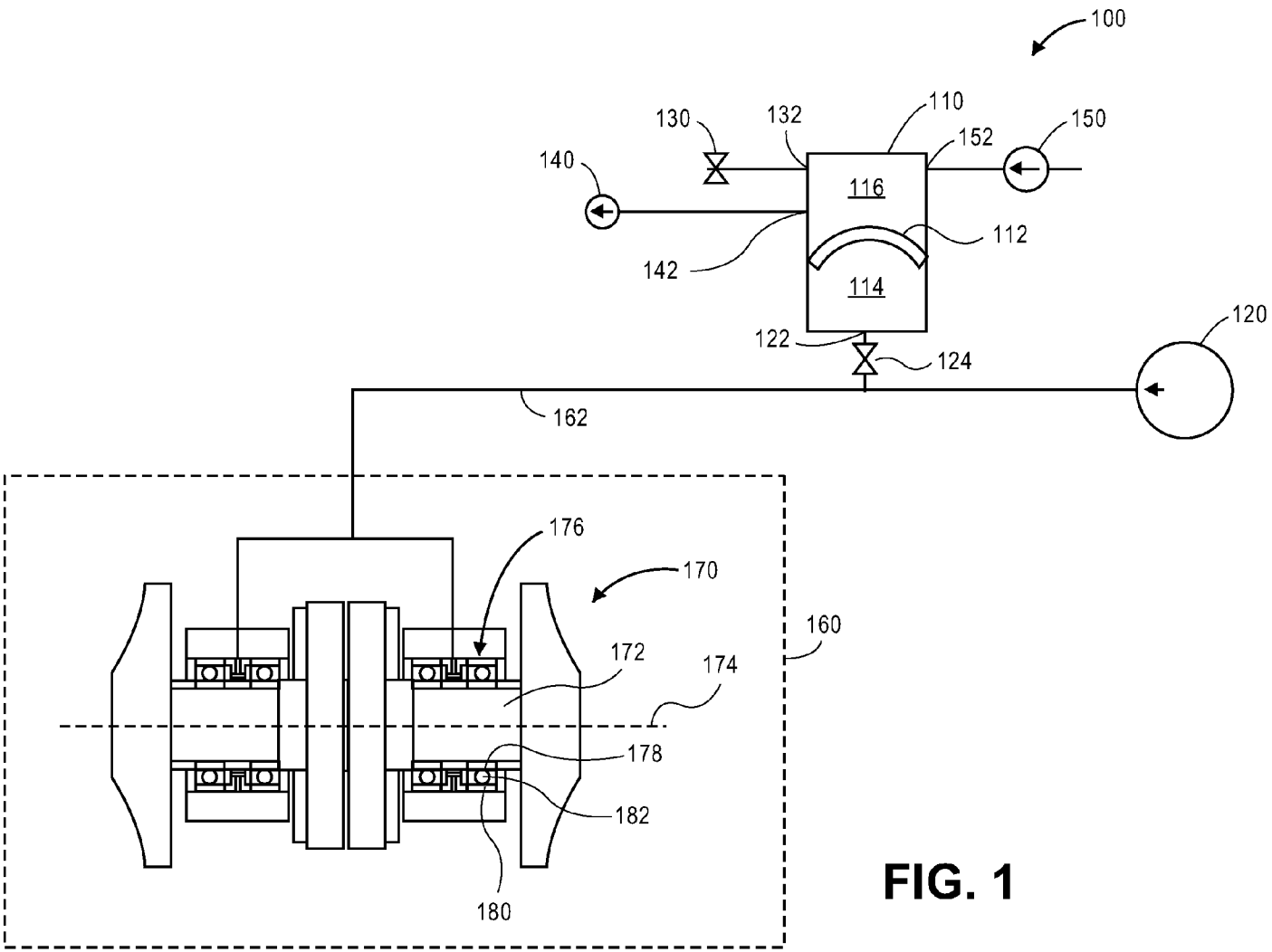
FIG. 1 illustrates a schematic view of a system for supplying a lubricant to a machine, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawings that form a part of the description, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

Additionally, when referring to a position or direction in a well, the terms "above," "up," "upward," "ascend," and various grammatical equivalents thereof may be used to refer to a position in a well that is closer to the surface than another position, or a movement or direction proceeding toward the surface (topside), without regard as to whether the well is vertical, deviated, or horizontal. Similarly, when referring to a position in a well, the terms "below," "down," "downward," and "descend" and various grammatical equivalents thereof may be used to refer to a position in a well that is farther from the surface than another position, or a direction or movement proceeding away from the surface, regardless of whether the well is vertical, deviated, or horizontal. Moreover, the terms "upper," "lower," "above," and "below," when referring to components of an apparatus, are used to conveniently refer to the relative positioning of components or elements, e.g., as illustrated in the drawings, and may not refer to any particular frame of reference. Thus, a component may be flipped or viewed in any direction, while parts thereof may remain unchanged in terms of being "upper" or "lower" etc.

FIG. 1 illustrates a schematic view of a system 100 for supplying a lubricant to a machine 160, according to an embodiment. The system 100 may include a tank 110 that defines an internal volume. A divider 112 may be positioned in the internal volume of the tank 110 that divides or separates the internal volume into two or more portions (two are shown: 114, 116). As shown, the divider 112 may be a diaphragm that is coupled to the inner surface of the tank 110. The diaphragm 112 may be made of a material that is configured to bend or flex as the first portion of the internal volume 114 increases and decreases in response to a pressure differential between the first and second portions of the internal volume 114, 116.

The tank 110 may have one or more openings (four are shown: 122, 132, 142, 152) that provide a path of fluid communication between the internal volume and the exterior of the tank 110. A first pump 120 (referred to hereafter as a liquid pump) may be in fluid communication with the first portion of the internal volume 114 of the tank 110 through a first one of the openings 122. As used herein, the term "pump" refers to all machines operable to increase and/or decrease a pressure in any type of fluid, whether gas, liquid, or a combination thereof. The liquid pump 120 may be used to introduce a liquid lubricant into the first portion of the internal volume 114 of the tank 110. The lubricant may be an oil or a refrigerant. Illustrative refrigerants may include R-134a, R-123, R-1233zd, R-1234ze, and the like.

A valve 130 may be in fluid communication with the second portion of the internal volume 116 of the tank 110 through a second one of the openings 132. The valve 130 may be used to allow gas to discharge (i.e. "bleed off") from the second portion of the internal volume 116 of the tank 110 when the lubricant is being introduced into the first portion of the internal volume 114.

A second pump 140 (referred to hereafter as a vacuum pump) may be in fluid communication with the second portion of the internal volume 116 of the tank 110 through a third one of the openings 142. The vacuum pump 140 may be used to withdraw the gas from the second portion of the internal volume 116 to reduce the pressure of the gas and leave behind a partial vacuum.

A third pump 150 (referred to hereafter as a gas pump) may be in fluid communication with the second portion of the internal volume 116 of the tank 110 through a fourth one of the openings 152. The gas pump 150 may be used to introduce a gas into the second portion of the internal volume 116 of the tank 110. As such, the gas pump 150 may be or include a compressor. The gas may be air.

Referring again to the first opening 122 in the tank 110, the first opening 122 may also be in fluid communication with a machine 160 via a conduit 162. In at least one embodiment, a valve 124 may be positioned in the conduit 162 between the tank 110 and the machine 160. A sensor (not shown) may be configured to sense when the lubricant supply to the machine 160 (e.g., from a primary lubricant supply system) is insufficient. When this occurs, the valve 124 may be switched from a closed position to an open position (e.g., manually or automatically) to supply the lubricant from the tank 110 to the machine 160.

The machine 160 may be any machine having relative movement between two or more components. As shown, the machine 160 is a chiller (e.g., a refrigeration chiller). The chiller 160 may include at least one compressor 170. In at least one embodiment, the lubricant may be the same fluid that the compressor 170 is compressing. The lubricant may be taken from either the evaporator or the condenser, depending on the operating conditions of the machine 160 and the state of the refrigerant. The compressor 170 may include a shaft 172 that is configured to rotate about a central longitudinal axis 174. The shaft 172 may be supported by one or more bearings (four are shown: 176). The bearings 176 may each include an inner ring or "race" 178, an outer ring or race 180, and one or more rolling elements (e.g., balls) 182 positioned therebetween. As described in greater detail below, the lubricant may flow from the first portion of the internal volume 114 of the tank 110 and be introduced to the bearings 176 (e.g., between the inner and outer rings 178, 180). In some embodiments, the bearings 176 may have steel or ceramic rolling elements.

Figure 2:
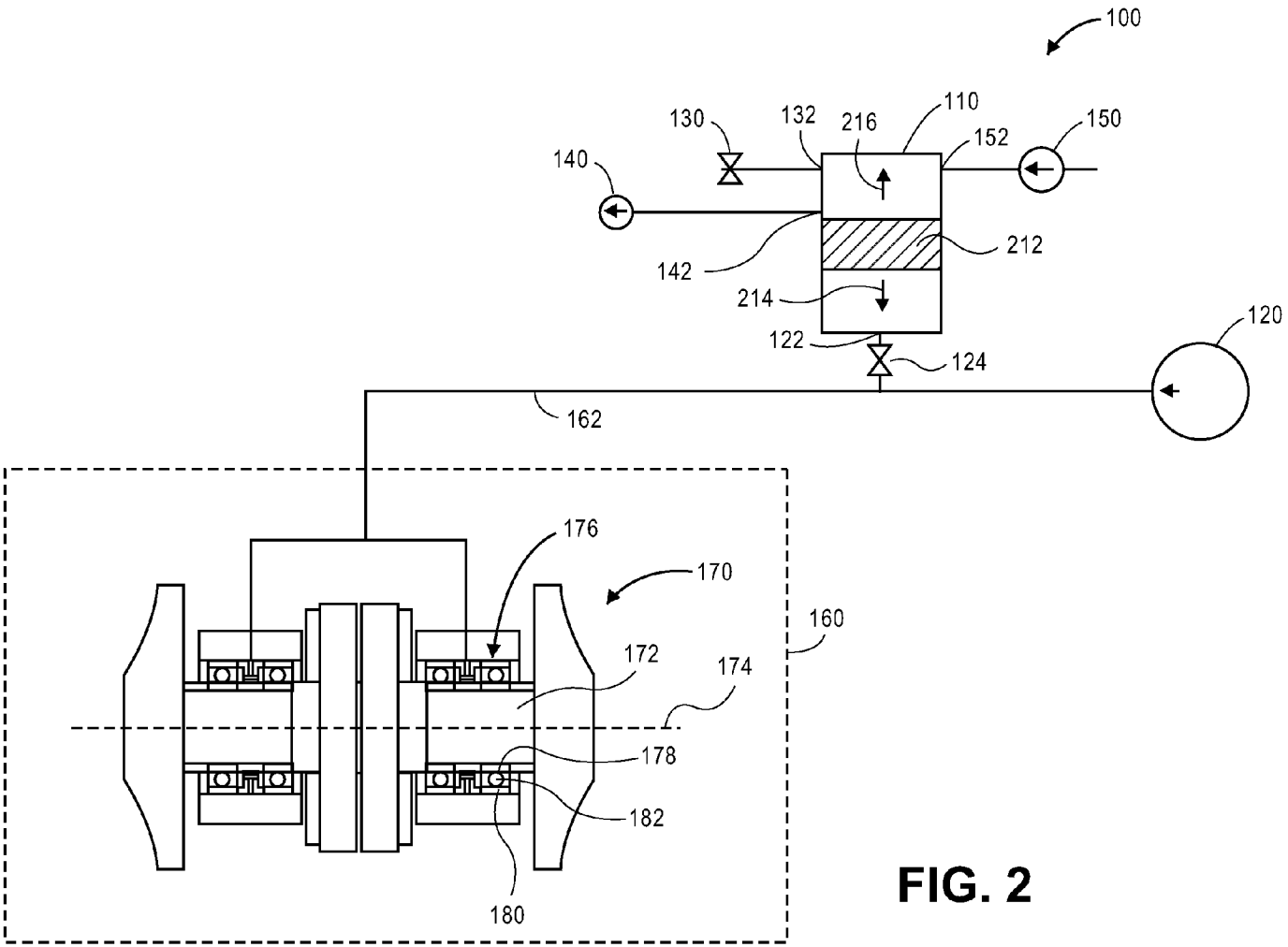
FIG. 2 illustrates a schematic view of the system showing the divider as a piston, according to an embodiment.

FIG. 2 illustrates a schematic view of the system 100 showing the divider 112 as a piston, according to an embodiment. In at least one embodiment, rather than the divider 112 being a diaphragm (as shown in FIG. 1), the divider 112 may be a piston (as shown in FIG. 2). The piston 212 may be positioned within the tank 110 and divide or separate the internal volume into the two portions 114, 116. The piston 212 may be configured to move within the tank 110 as the first portion of the internal volume 114 increases and decreases in response to a pressure differential between the first and second portions of the internal volume 114, 116. For example, the piston 212 may move in a first axial direction 214 (e.g., down as shown in FIG. 2) when the pressure of the gas in the second portion of the internal volume 116 is greater than the pressure of the lubricant in the first portion of the internal volume 114. Similarly, the piston 212 may move in a second axial direction 216 (e.g., up as shown in FIG. 2) when the pressure of the lubricant in the first portion of the internal volume 114 is greater than the pressure of the gas in the second portion of the internal volume 116.

Figure 3:
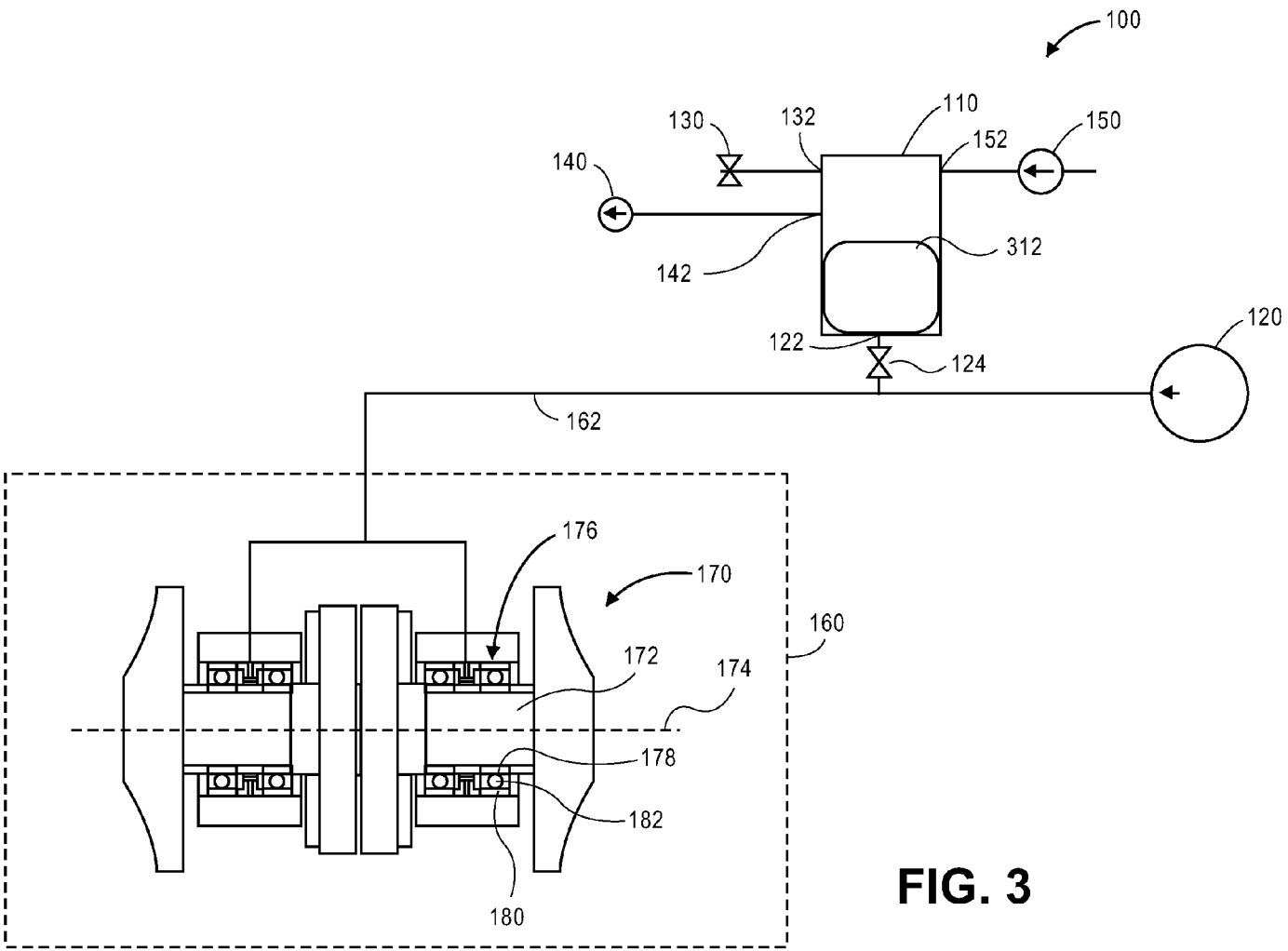
FIG. 3 illustrates a schematic view of the system showing the divider as a bladder, according to an embodiment.
Figure 4:
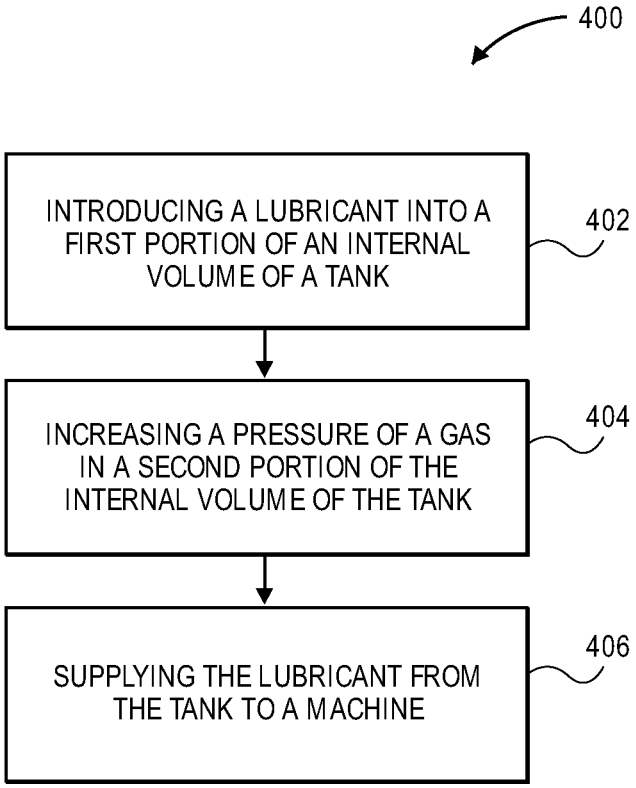
FIG. 4 illustrates a flowchart of a method for providing lubrication to a machine, according to an embodiment.

FIG. 3 illustrates a schematic view of the system 100 showing the divider 112 as a bladder, according to an embodiment. In at least one embodiment, rather than the divider 112 being a diaphragm (as shown in FIG. 1) or a piston (as shown in FIG. 2), the divider 112 may be a bladder (as shown in FIG. 3). The bladder 312 may be positioned within the tank 110 and divide or separate the internal volume into the two portions 114, 116. More particularly, the bladder 312 may include a flexible "bag" that defines an internal volume that is configured to receive the lubricant. In at least one embodiment, the bladder 312 may be made from a polymer or elastomer (e.g., rubber). The bladder 312 may include an opening that is in fluid communication with the first opening 122 in the tank 110.

With continuing reference to FIGS. 1-3, FIG. 4 illustrates a flowchart of a method 400 for providing lubrication to a machine, according to an embodiment. The method 400 may proceed by operation of an embodiment of the system 100, for example, and may thus be best understood with reference thereto. However, it will be appreciated that the method 400 is not limited to any particular structure unless otherwise stated herein. In addition, the steps below may be conducted in any order, and the order described below is for illustrative purposes only.

The method 400 may include introducing a lubricant (e.g., a refrigerant) into a first portion of an internal volume of a tank, as at 402. In one embodiment, the lubricant may be pumped into the first portion of the internal volume with a first or "liquid" pump. A valve that is in fluid communication with a second portion of the internal volume of the tank may be open as the lubricant is pumped into the first portion of the internal volume of the tank. This may allow a gas within the second portion of the internal volume to discharge from the second portion of the internal volume to make room for the lubricant in the first portion of the internal volume. The valve may be closed once the lubricant is stored in the first portion of the internal volume.

In another embodiment, instead of, or in addition to, using the liquid pump to introduce the lubricant into the first portion of the internal volume, a second or "vacuum" pump may withdraw at least a portion of the gas from the second portion of the internal volume, leaving behind a partial vacuum in the second portion of the internal volume. This partial vacuum may draw the lubricant into the first portion of the internal volume.

The method 400 may also include increasing a pressure of the gas in the second portion of the internal volume of the tank, as at 404. In one embodiment, additional gas (e.g., air) may be pumped into the second portion of the internal volume with a third or "gas" pump to increase the pressure in the second portion of the internal volume. The gas pump may be controlled to maintain a predetermined pressure in the first portion of the internal volume and/or the second portion of the internal volume. For example, the pressurized gas in the second portion of the internal volume may exert a force on the lubricant in the first portion of the internal volume via a diaphragm, a piston, a bladder, or the like positioned between the first and second portions. This may cause the pressure of the lubricant in the first portion of the internal volume to increase, and the pressure may be maintained at this level until the lubricant is released to a machine, as discussed below. In one embodiment, the vacuum and gas pumps may be a single pump that includes a switch at the inlet and outlet sides so that it may serve to increase and decrease the pressure of the gas based on the position of the switch.

The method 400 may also include supplying the lubricant from the tank to a machine, as at 406. More particularly, a sensor may sense when the lubricant supplied to the machine (e.g., from a primary lubrication system) is insufficient. When this occurs, a valve positioned between the tank and the machine may be switched to an open position, and the (now pressurized) lubricant may flow through the valve and to the machine. The lubricant may be supplied to one or more bearings in the machine. By using back pressure to facilitate the flow of the lubricant, the lubricant may flow easier than when compared to a conventional gravity-fed system. In addition, by using back pressure, the lubricant may be supplied in a sub-cooled liquid state.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A compressor system, comprising:

a compressor configured to compress a liquid refrigerant, wherein the compressor comprises at least one bearing; and a lubricant supply system configured to provide the liquid refrigerant to the at least one bearing of the compressor, wherein the lubricant supply system comprises:

a tank defining an internal volume;

a divider positioned within the tank that separates the internal volume into a first portion and a second portion, wherein the first portion is filled with the liquid refrigerant;

a first pump in fluid communication with the first portion of the tank; and a conduit extending from the first pump to the compressor, the first pump being in fluid communication with the at least one bearing via the conduit, wherein the first pump is configured to introduce a portion of the liquid refrigerant into the first portion of the internal volume and to introduce, via the conduit, a portion of the liquid refrigerant to the at least one bearing, and wherein the first portion of the tank is configured to selectively increase a pressure of the liquid refrigerant supplied by the first pump to the at least one bearing in the conduit.

2. The compressor system of claim 1, wherein the divider comprises a diaphragm that is coupled to an inner surface of the tank and configured to flex as a volume of the first portion of the internal volume increases and decreases in response to a pressure differential between the first and second portions of the internal volume.

3. The compressor system of claim 1, wherein the divider comprises a piston that is configured to move within the tank as a volume of the first portion of the internal volume increases and decreases in response to a pressure differential between the first and second portions of the internal volume.

4. The compressor system of claim 1, wherein the divider comprises a bladder at least partially surrounding the first portion of the internal volume.

5. The compressor system of claim 4, wherein the bladder is configured to flex as a volume of the first portion of the internal volume increases and decreases in response to a pressure differential between the first and second portions of the internal volume.

6. The compressor system of claim 1, wherein the tank defines an opening that provides a path of fluid communication between the second portion of the internal volume and an exterior of the tank, and further comprising a valve in fluid communication with the opening and configured to allow gas to discharge from the second portion of the internal volume as the refrigerant is introduced into the first portion of the internal volume.

7. The compressor system of claim 1, further comprising a second pump in fluid communication with the second portion of the internal volume, wherein the second pump is configured to reduce a pressure of a gas in the second portion of the internal volume.

8. The compressor system of claim 1, further comprising a second pump in fluid communication with the second portion of the internal volume, wherein the second pump is configured to increase a pressure of a gas in the second portion of the internal volume, which thereby increases a pressure of the refrigerant in the first portion of the internal volume.

9. The compressor system of claim 1, wherein the conduit receives the portion of the liquid refrigerant from the first pump without the portion of the liquid refrigerant from the pump proceeding into the tank.

10. The compressor system of claim 1, wherein the conduit is in selective fluid communication with the first portion of the internal volume of the tank.

11. A compressor system, comprising:

a compressor configured to compress a liquid refrigerant, wherein the compressor comprises at least one bearing; and a lubricant supply system configured to provide the liquid refrigerant to the at least one bearing of the compressor, wherein the lubricant supply system comprises:

a tank defining an internal volume;

a divider positioned within the tank that separates the internal volume into a first portion and a second portion, wherein the first portion is filled with the liquid refrigerant; and a first pump in fluid communication with the at least one bearing and with the first portion of the internal volume, wherein the first pump is configured to introduce the liquid refrigerant into the first portion of the internal volume and to the at least one bearing, and wherein the first portion of the tank is configured to selectively increase a pressure of the liquid refrigerant supplied by the first pump to the at least one bearing, wherein:

the tank defines an opening that provides a path of fluid communication between the first portion of the internal volume and an exterior of the tank;

the lubricant supply system further comprises a valve in fluid communication with the opening and the first pump; and the valve is configured to open to allow the refrigerant to flow out of the first portion of the tank and combine with the liquid refrigerant from the first pump and proceed to the at least one bearing, and to close to prevent the refrigerant from flowing therethrough.

12. A lubricant supply system, comprising:

a tank defining an internal volume;

a divider positioned within the tank that separates the internal volume into a first portion and a second portion, wherein a backup liquid refrigerant is stored in the first portion of the internal volume, and wherein a gas is stored in the second portion of the internal volume;

a gas pump in fluid communication with the second portion of the internal volume and configured to vary a pressure of the gas in the second portion, wherein a pressure of the backup liquid refrigerant in the first portion of the internal volume increases when the gas pump causes the pressure of the gas to increase;

a liquid pump configured to pump a primary liquid refrigerant; and a conduit fluidly coupling the liquid pump to the first portion of the internal volume of the tank and to a refrigerant compressor, wherein the conduit is configured to receive the primary liquid refrigerant from the refrigerant compressor, and to receive the backup liquid refrigerant from the first portion of the internal volume, and provide the primary and backup liquid refrigerants to the compressor.

13. The lubricant supply system of claim 12, wherein the tank defines an opening that provides a path of fluid communication between the second portion of the internal volume and an exterior of the tank, and further comprising a valve in fluid communication with the opening and configured to allow the gas to discharge from the second portion of the internal volume as the refrigerant is introduced into the first portion of the internal volume.

14. The lubricant supply system of claim 12, wherein the divider is selected from the group consisting of: a diaphragm, a piston, and a bladder.

15. The lubricant supply system of claim 12, further comprising:

a valve positioned in the conduit, wherein, when the valve is in an open position, the backup liquid refrigerant is communicable from the first portion of the internal volume to at least one bearing of the refrigerant compressor via the conduit, and wherein, when the valve is in a closed position, the backup liquid refrigerant is prevented from communicating from the first portion of the internal volume to the at least one bearing via the conduit.

16. The lubricant supply system of claim 12, wherein the conduit is directly coupled to the pump.

* * * * *